US008220797B2

(12) United States Patent
Yamamoto et al.

(10) Patent No.: US 8,220,797 B2
(45) Date of Patent: Jul. 17, 2012

(54) IMAGE RECORDING APPARATUS

(75) Inventors: Shinya Yamamoto, Nagoya (JP); Kiyoshi Sugimoto, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 246 days.

(21) Appl. No.: 12/559,571

(22) Filed: Sep. 15, 2009

(65) Prior Publication Data

US 2010/0078877 A1 Apr. 1, 2010

(30) Foreign Application Priority Data

Sep. 26, 2008 (JP) ..... 2008-247951

(51) Int. Cl.
*B65H 39/10* (2006.01)

(52) U.S. Cl. ..... 271/302; 271/189; 271/264; 347/33

(58) Field of Classification Search ..... 271/264, 271/189, 190, 301, 302; 347/33
See application file for complete search history.

(56) References Cited

U.S. PATENT DOCUMENTS

| | | | | |
|---|---|---|---|---|
| 6,267,368 | B1 * | 7/2001 | Tomoe et al. | 271/9.09 |
| 6,728,012 | B2 * | 4/2004 | Bacher et al. | 358/498 |
| 7,229,149 | B2 * | 6/2007 | Wotton et al. | 347/33 |
| 7,389,062 | B2 * | 6/2008 | Hashimoto et al. | 399/68 |
| 7,399,056 | B2 * | 7/2008 | Nakashima et al. | 347/29 |
| 7,506,948 | B2 | 3/2009 | Nonaka | |
| 2005/0194730 | A1 * | 9/2005 | Nishida et al. | 271/10.01 |
| 2008/0211863 | A1 * | 9/2008 | Chikamoto | 347/33 |
| 2008/0231655 | A1 * | 9/2008 | Yamada | 347/30 |
| 2009/0102908 | A1 | 4/2009 | Imoto | |
| 2010/0079528 | A1 * | 4/2010 | Yamamoto | 347/16 |
| 2010/0239344 | A1 * | 9/2010 | Mihara | 399/405 |
| 2011/0033198 | A1 * | 2/2011 | Sasahara et al. | 399/92 |

FOREIGN PATENT DOCUMENTS

| | | | |
|---|---|---|---|
| JP | 2003-341898 | A | 12/2003 |
| JP | 2005-246727 | A | 9/2005 |
| JP | 2006-082546 | A | 3/2006 |
| JP | 2006-089203 | A | 4/2006 |
| JP | 2008-214020 | A | 9/2008 |
| WO | WO 2008108190 | A1 * | 9/2008 |

OTHER PUBLICATIONS

Japan Patent Office; Notification of Reason for Refusal in Japanese Patent Application No. 2008-247951 (counterpart to the above-captioned US Patent Application) mailed on Aug. 3, 2010.

* cited by examiner

*Primary Examiner* — Michael McCullough
*Assistant Examiner* — Howard Sanders
(74) *Attorney, Agent, or Firm* — Baker Botts L.L.P.

(57) ABSTRACT

An image recording apparatus, including: a recording head configured to record an image on a recording medium; a conveying mechanism disposed so as to face the recording head and configured to convey the recording medium in a medium conveyance direction that is substantially horizontal; a retaining portion disposed configured to hold and retain the recording medium on which the image has been recorded by the recording head, such that the recording medium is held and retained in a substantially horizontal posture; and a medium receiving portion to which the recording medium on which the image has been recorded by the recording head is discharged, wherein the recording head, the retaining portion, and the medium receiving portion are arranged in a vertical direction.

16 Claims, 3 Drawing Sheets

MAIN SCANNING DIRECTION

SUB SCANNING DIRECTION

IMAGE RECORDING APPARATUS

CROSS REFERENCE TO RELATED APPLICATION

The present application claims priority from Japanese Patent Application No. 2008-247951, which was filed on Sep. 26, 2008, the disclosure of which is herein incorporated by reference in its entirety.

BACKGROUND OF THE INVENTION

1. Field of the Invention

The present invention relates to an image recording apparatus configured to record an image on a recording medium.

2. Discussion of Related Art

There has been disclosed in the following Patent Document 1 an image recording apparatus having a recording head of a serial type configured to move, during a recording operation, in a direction perpendicular to a sheet conveyance direction, i.e., to move in a main scanning direction. In the disclosed image recording apparatus, a sheet retaining portion is disposed on a downstream side of the recording head, and a sheet on which recording has been performed is retained by the sheet retaining portion such that the sheet is held from the upper and lower sides thereof, whereby curl of the recorded sheet is suppressed.

Patent Document 1: JP-A-2006-82546 (FIG. 1)

SUMMARY OF THE INVENTION

In the image recording apparatus disclosed in the above Patent Document 1, the sheet retaining portion and the recording head are disposed side by side in the sheet conveyance direction, inevitably resulting in an increase in the size of the apparatus in the sheet conveyance direction.

It is therefore an object of the invention to provide an image recording apparatus having a reduced size in the sheet conveyance direction.

The above-indicated object may be attained according to a principle of the invention, which provides an image recording apparatus, comprising: a recording head configured to record an image on a recording medium; a conveying mechanism disposed so as to face the recording head and configured to convey the recording medium in a medium conveyance direction that is substantially horizontal; a retaining portion disposed configured to hold and retain the recording medium on which the image has been recorded by the recording head, such that the recording medium is held and retained in a substantially horizontal posture; and a medium receiving portion to which the recording medium on which the image has been recorded by the recording head is discharged, wherein the recording head, the retaining portion, and the medium receiving portion are arranged in a vertical direction.

In the image recording apparatus according to the present invention, the recording head, the retaining portion, and the medium receiving portion are arranged in the vertical direction, so that it is possible to downsize the apparatus in the medium conveyance direction.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAIL DESCRIPTION OF THE PREFERRED EMBODIMENT

There will be hereinafter described a preferred embodiment of the invention with reference to the drawings. Referring to the schematic cross sectional view of FIG. 1, there will be explained an ink-jet printer according to the embodiment of the invention, to which the principle of the invention is applied. The ink-jet printer is configured to record characters and images on a recording sheet as a recording medium by ejecting ink thereon.

Figure 1:
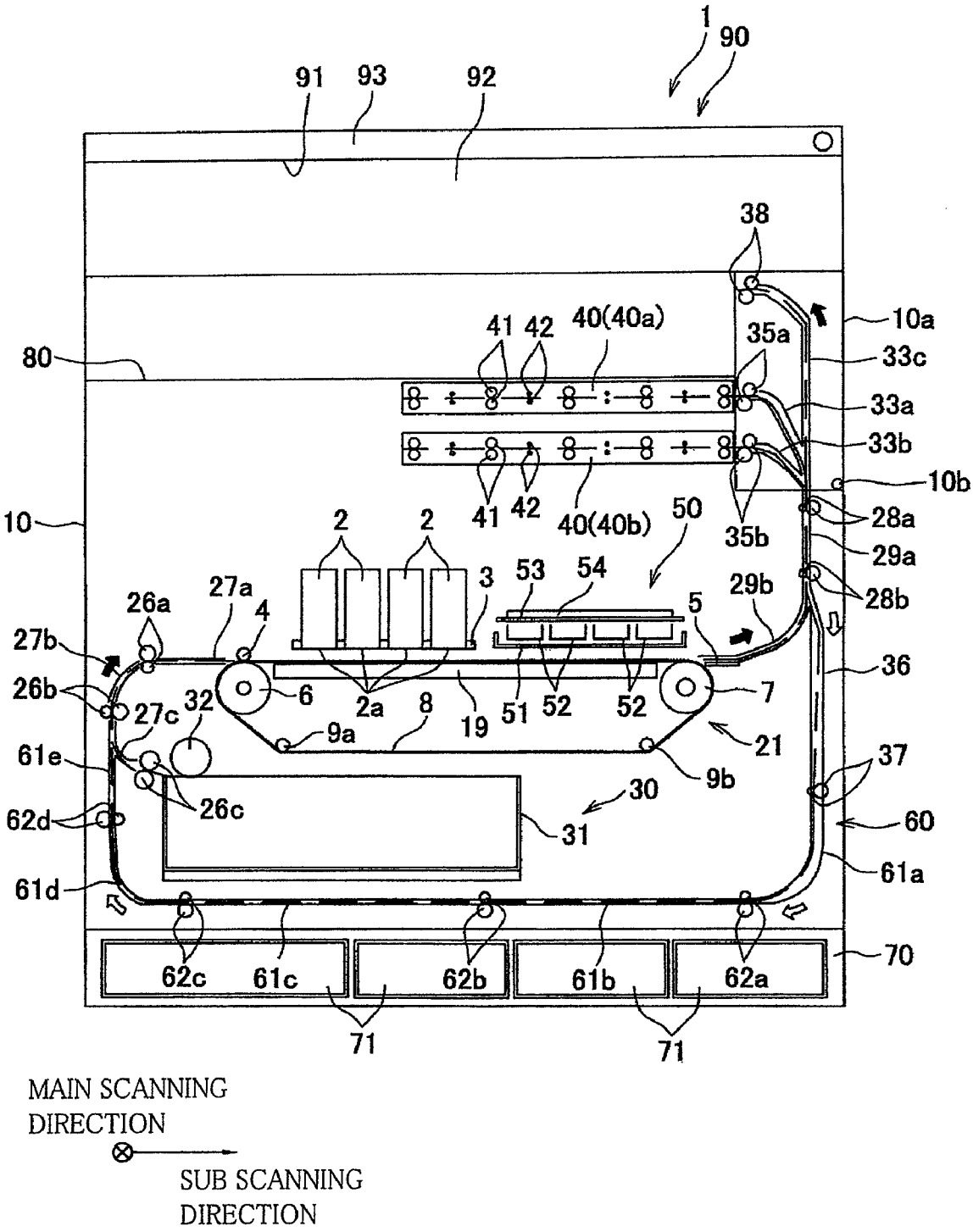
FIG. 1 is a schematic view in cross section of an ink-jet printer according to one embodiment of the invention.

The ink-jet printer as an image recording apparatus generally indicated at 10 in FIG. 1 includes a casing 10 having an internal space. In the internal space of the casing 10, there are disposed, in order in a direction directing from the upper portion toward the lower portion of the internal space of the casing 10, two sheet retaining units 40 (each as a retaining portion) aligned with each other in the vertical direction, four ink jet heads 2 and a maintenance unit 50 which are disposed side by side in a sub scanning direction (i.e., in a left-right direction in FIG. 1), a sheet conveying mechanism 21, a sheet supplier 30 as a supply portion, and an ink tank cassette 70. On the upper side of the casing 10, there is disposed a sheet receiving portion as a medium receiving portion to which the sheet is discharged. The ink-jet printer 1 further includes a control portion 100 (FIG. 3) for controlling various operations of the printer 1. An upper one of the two sheet retaining units 40 is referred to as a sheet retaining unit 40*a* while a lower one of the two sheet retaining units 40 is referred to as a sheet retaining unit 40*b*. In the arrangement, the ink-jet heads 2, the sheet retaining portions 40, and the sheet receiving portion 80 at least partially overlap each other as viewed from the top of the ink-jet printer 1.

In the internal space of the casing 10 of the ink-jet printer 1, there are formed: a sheet delivery path through which the sheet is delivered along solid arrows in FIG. 1 from the sheet supplier 30 toward the sheet receiving portion 80; and a sheet return path 60 as a medium return path through which the sheet that has been delivered through the sheet delivery path is delivered along open arrows in FIG. 1. The sheet return path 60 is configured such that the sheet delivered therethrough passes below the sheet conveying mechanism 21.

The sheet supplier 30 has: a sheet cassette 31 in which a stack of the sheets can be accommodated; a sheet supply roller 32 configured to supply each sheet from the sheet cassette 31; and a sheet supply motor 132 (FIG. 3) configured to rotate the sheet supply roller 32. The sheet supplier 30 is disposed below the ink-jet heads 2, whereby the ink-jet printer 1 is downsized in the sub scanning direction.

The sheet supply roller 32 is configured to come into rolling contact with an uppermost one of the sheets stacked in the sheet cassette 31, thereby feeding the uppermost sheet from the sheet cassette 31. On a part of the sheet delivery path between the sheet cassette 31 and the sheet conveying mechanism 21 located on the left side of the sheet conveying mechanism 21 as seen in FIG. 1, there are disposed: sheet guides 27*a*-27*c* that extend in a curved form from the sheet cassette 31 toward the sheet conveying mechanism 21; a roller pair 26*a* disposed between the sheet guides 27*a* and 27*b*, a roller pair 26*b* disposed between the sheet guides 27*b* and 27*c*, and a separating roller pair 26*c* disposed adjacent to the sheet cassette 31. One roller of each of the roller pairs 26*a*, 26*b*, 26*c* is a drive roller configured to be rotated by a feed motor not shown while the other roller of each of the roller pairs 26*a*, 26*b*, 26*c* is a driven roller configured to be rotated in accordance with rotation of the one roller as the drive roller. The sheet that has come into contact with the sheet supply roller 32 is delivered to the sheet conveying mechanism 21 while being guided by the sheet guides 27*a*-27*c* and nipped by the rollers of each of the roller pairs 26*a*, 26*b* and the rollers of the separating roller pair 26*c*.

The sheet conveying mechanism 21 includes: two belt rollers 6, 7; an endless sheet conveyor belt 8 wound around the two rollers 6, 7 so as to be stretched therebetween; tension rollers 9*a*, 9*b* which are in contact with the inner circumferential surface of the sheet conveyor belt 8 at the lower half portion of the loop of the sheet conveyor belt 8 while being biased downwardly, thereby applying tension to the sheet conveyor belt 8; and a sheet delivery motor 133 (FIG. 3) configured to rotate the belt roller 7. The sheet conveying mechanism 21 is configured to convey the sheet in a sheet conveyance direction (as a medium conveyance direction) that is horizontal, i.e., in the sub scanning direction. The belt roller 7 is a drive roller configured to be rotated clockwise in FIG. 1 by driving of the sheet delivery motor 133. The belt roller 6 is a driven roller configured to be rotated clockwise in FIG. 1 by the movement of the sheet conveyor belt 8 in accordance with rotation of the belt roller 7.

The outer circumferential surface of the sheet conveyor belt 8 is silicone-treated so as to have adhesion property. A nip roller 4 is disposed at a position on the sheet delivery path at which the nip roller 4 faces the belt roller 6 with the sheet conveyor belt 8 interposed therebetween. The nip roller 4 is configured to press the sheet supplied from the sheet cassette 31 onto the outer circumferential surface of the sheet conveyor belt 8. The sheet pressed onto the outer circumferential surface of the sheet conveyor belt 8 is conveyed in the rightward direction in FIG. 1 while being held on the outer circumferential surface of the sheet conveyor belt 8 owing to its adhesion property.

A separation plate 5 is disposed on the downstream side of the belt roller 7 in the sheet conveyance direction, so as to be adjacent to the same 7. The separation plate 5 separates the sheet held on the outer circumferential surface of the sheet conveyor belt 8 therefrom. On a part of the sheet delivery path in the casing 10 between the sheet conveying mechanism 21 and the sheet retaining units 40 or the sheet receiving portion 80, there are disposed: sheet guides 29*a*, 29*b*, 33; and a roller pair 28*a* disposed between the sheet guides 29*a* and 33 and a roller pair 28*b* disposed between the sheet guides 29*a* and 29*b*. At a downstream end of the sheet guide 33 which is branched into the three branched guides 33*a*, 33*b*, 33*c*, three roller pairs 35*a*, 35*b*, 38 are disposed so as to respectively correspond to the three branched guides 33*a*, 33*b*, 33*c*. One roller of each of the roller pairs 28*a*, 28*b*, 35*a*, 35*b*, 38 is a drive roller configured to be rotated by a feed motor not shown while the other roller of each roller pair is a driven roller configured to be rotated in accordance with rotation of the one roller as the drive roller.

The sheet that has been separated from the outer circumferential surface of the sheet conveyor belt 8 by the separation plate 5 is delivered upward while being guided by the sheet guides 29*a*, 29*b* and nipped by the rollers of each of the roller pairs 28*a*, 28*b*. Subsequently, the sheet delivered upward is guided by the sheet guide 33 and is delivered selectively to one of: any one of the two sheet retaining units 40*a*, 40*b*; and the sheet receiving portion 80.

Figure 2:
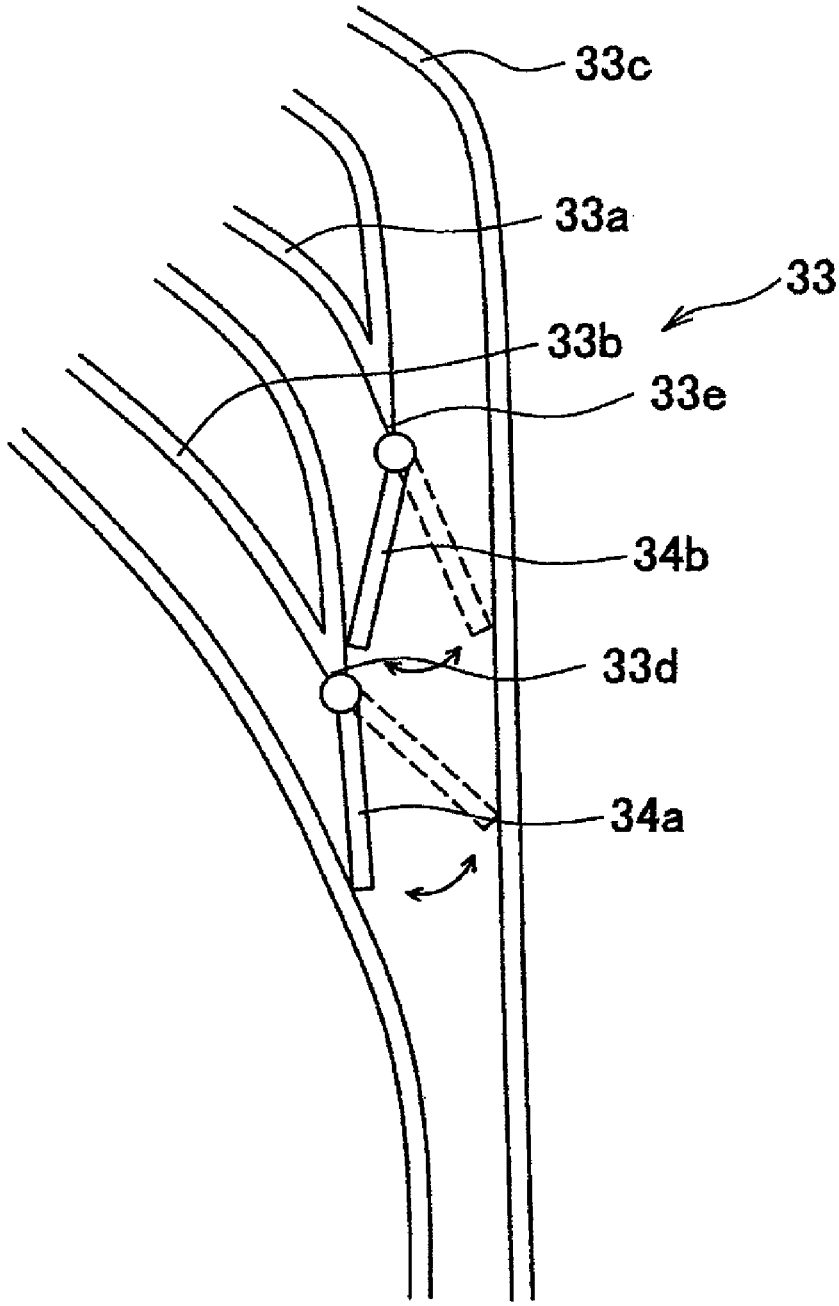
FIG. 2 is an enlarged cross sectional view of a sheet guide.

As shown in FIG. 2, the sheet guide 33 is branched into three portions at its intermediate position so as to provide three branched guides 33*a*, 33*b*, 33*c*. The sheet guide 33 has two distributing plates 34*a*, 34*b* for distributing the sheet delivered from the sheet guide 29*a* into one of: any one of the branched guides 33*a*, 33*b*; and the sheet receiving portion 80.

Figure 3:
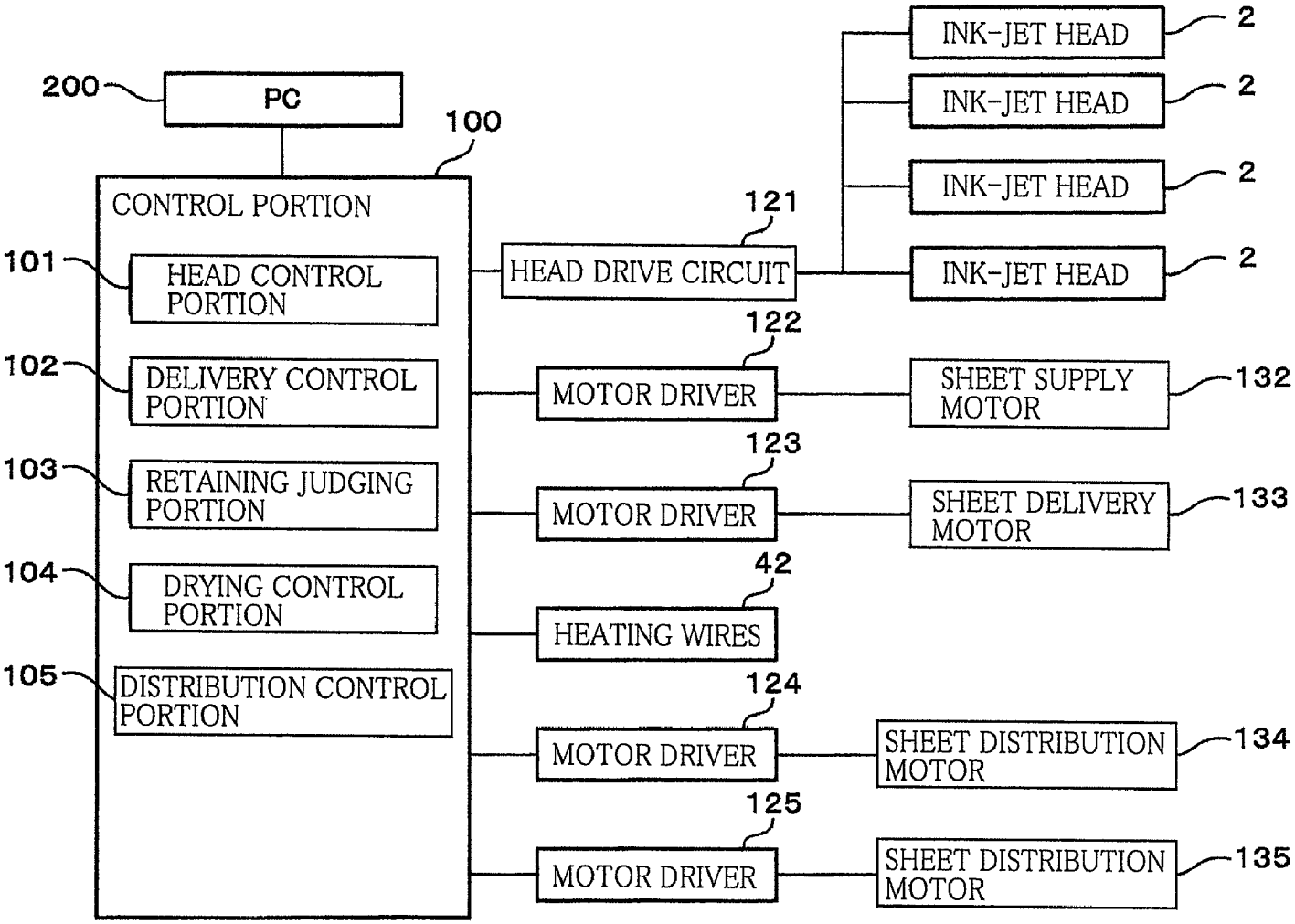
FIG. 3 is a block diagram of the ink-jet printer according to the embodiment of the invention.

The distributing plate 34*a* extends from an intersecting point 33*d* at which the two branched guides 33*a*, 33*b* intersect, into the inside of the sheet guide 33. The distributing plate 34*a* is disposed so as to be swingable about one end thereof contacting the intersecting point 33*d*, between a position indicated by the solid line in FIG. 2 and a position indicated by the broken line in FIG. 2, owing to driving of a sheet distribution motor 134 (FIG. 3).

The distributing plate 34*b* extends from an intersecting point 33*e* at which the two branched guides 33*a*, 33*c* intersect, into the inside of the sheet guide 33. The distributing plate 34*b* is disposed so as to be swingable about one end thereof contacting the intersecting point 33*e*, between a position indicated by the solid line in FIG. 2 and a position indicated by the broken line in FIG. 2, owing to driving of a sheet distribution motor 135 (FIG. 3).

When the distributing plate 34*a* is located at the position indicated by the broken line in FIG. 2 at which the distributing plate 34*a* is in contact with one of two side walls of the sheet guide 33, the sheet delivered by the sheet guide 29*a* is delivered into the lower sheet retaining unit 40*b* while being guided by the branched guide 33*b* and nipped by the rollers of the roller pair 35*b*. In a state in which the distributing plate 34*a* is located at the position indicated by the solid line in FIG. 2 at which the distributing plate 34*a* is in contact with the other of the two side walls of the sheet guide 33 and the distributing plate 34*b* is located at the position indicated by the broken line in FIG. 2 at which the distributing plate 34*b* is in contact with the one of the two side walls of the sheet guide 33, the sheet delivered by the sheet guide 29*a* is delivered into the upper sheet retaining unit 40*a* while being guided by the branched guide 33*a* and nipped by the rollers of the roller pair 35*a*. In a state in which the distributing plate 34*a* is located at the position indicated by the solid line in FIG. 2 and the distributing plate 34*b* is located at the position indicated by the solid line in FIG. 2 at which the distributing plate 34*b* is in contact with an intermediate wall of the sheet guide 33 that partially defines the branched guide 33*a*, the sheet delivered by the sheet guide 29*a* is delivered to the sheet receiving portion 80 while being guided by the branched guide 33*c* and nipped by the rollers of the roller pair 38. It is noted that the distributing plates 34*a*, 34*b*, the distribution motors 134, 135, and motor drivers 124, 125 (which will be described) cooperate to provide a distributing mechanism in the invention.

Referring back to FIG. 1, each of the sheet retaining units 40 (40*a*, 40*b*) includes a plurality of roller pairs 41 arranged in a direction parallel to the sub scanning direction and a plurality of sets of heating wires 42 each as a drier arranged in the same direction in which the roller pairs 41 are arranged. Each roller pair 41 includes two rollers, i.e., an upper roller and a lower roller, that are aligned in the vertical direction. Each set of the heating wires 42 is interposed between adjacent two of the plurality of roller pairs 41 and includes two heating wires 42 aligned in the vertical direction. The sheet delivered into each sheet retaining unit 40 is nipped by the rollers of each of the roller pairs 41 and is held substantially flat along the sub scanning direction. The inside of each sheet retaining unit 40 is kept at an elevated temperature owing to the heat generated by voltage application to the heating wires 42. Accordingly, the sheet delivered into each sheet retaining unit 40 and nipped by the rollers of the roller pairs 41 is dried while being held in the substantially horizontal posture. The lower roller of each roller pair 41, namely, the roller of each roller pair 41 that comes into contact with the recorded surface of the sheet, is formed as a spur roller for the purpose of minimizing adhesion of ink still existing on the recorded surface of the sheet without being sufficiently permeated into the sheet.

According to the arrangement described above, the sheet on which the image has been recorded can be quickly dried by the heat generated by the heating wires 42, so that the ink can be quickly permeated into the sheet and the curl of the sheet can be prevented. As compared with an arrangement in which the heating wires 42 are not employed, the present arrangement described above reduces a retention time during which the sheet is retained by each sheet retaining unit 40. The heat generated by the heating wires 42 tends to flow upward. In view of this, the retaining units 40 in which the heating wires 42 are provided are disposed above the ink-jet heads 2 in the present embodiment, whereby it is possible to prevent the ejection performance of the ink-jet heads 2 from being adversely influenced by the heat generated by the heating wires 42. The sheet retained by each of the sheet retaining units 40 may be considered to be kept in a standby state for being delivered after a suitable retention time. In this sense, the sheet retaining unit 40 may be referred to as "standby portion".

A side wall portion 10*a* as a part of the casing 10 is rotatable about a shaft 10*b* that extends in a main scanning direction, together with the sheet guide 33 and the roller pairs 35*a*, 35*b*, 38. The two sheet retaining units 40*a*, 40*b* can be detached from the casing 10 in a direction parallel to a sheet delivery direction in which the sheet is delivered (in a direction opposite to the sheet delivery direction in the present embodiment), through a spacing formed by rotating the side wall portion 10*a* clockwise, together with the sheet guide 33 and the roller pairs 35*a*, 35*b*, 38. In a case where the sheet retaining units 40 are configured to be detached from the casing 10 in a direction parallel to the main scanning direction, the sheet would be torn when the sheet retaining units 40 are pulled out from the casing 10, if the sheet remained astride the inside in the casing 10 and each of the sheet retaining units 40. In the present arrangement, in contrast, the sheet retaining units 40 are configured to be detachable along the sheet delivery direction. Accordingly, when the sheet retaining units 40 are completely detached from the casing 10, the sheet remaining in the casing 10 is easily visible, whereby sheet jamming can be easily dealt with.

The above indicated one roller, as the drive roller, of each of the roller pairs 28*a*, 28*b*, 35*a*, 35*b* is a switchback roller, and is rotatable in a direction opposite to a direction in which the roller rotates when the sheet is delivered from the sheet conveyor belt 8 to one of the sheet retaining units 40. When the rollers of each of the roller pairs 28*a*, 28*b* and the rollers of the roller pair 35*a* or 35*b* rotate in the above-indicated opposite direction with the trailing end of the sheet that has been delivered into the sheet retaining unit 40*a* or 40*b* nipped by and between the rollers of the roller pair 35*a* or 35*b*, the sheet is switchback-delivered downward while being guided by a sheet guide 36 and nipped by the rollers of the roller pair 37. At a joint between the sheet guide 29*b* and the sheet guide 36, there is disposed a distributing plate having a structure similar to that of the above-indicated distributing plate 34*a*, whereby the sheet delivered downward by the sheet guide 29*a* can be delivered toward the sheet guide 36.

On the sheet return path 60, there are disposed, in addition to the above-indicated sheet guide 36 and roller pair 37, sheet guides 61*a*-61*e*, a roller pair 62*a* disposed between the sheet guides 61*a* and 61*b*, a roller pair 62*b* disposed between the sheet guides 61*b* and 61*c*, a roller pair 62*c* disposed between the sheet guides 61*c* and 61*d*, and a roller pair 62*d* disposed between the sheet guides 61*d* and 61*e*. One roller of each of the roller pairs 62*a*-62*d* is a drive roller configured to be rotated by a feed motor not shown while the other roller of each roller pair is a driven roller configured to be rotated in accordance with rotation of the one roller as the drive roller. The sheet guide 61*e* is joined to the sheet guide 27*c*.

The sheet switchback-delivered downward while being guided by the sheet guide 36 and nipped by and between the rollers of the roller pair 37 is delivered to the sheet conveying mechanism 21 through the sheet return path 60 while being guided by the sheet guides 61*a*-61*e* and nipped by and between the rollers of each of the roller pairs 62*a*-62*d*. In this instance, skewing of the sheet is corrected by a skew-correcting roller not shown. The sheet delivered to the sheet conveying mechanism 21 through the sheet return path 60 faces the ink-jet heads 2 at one surface thereof opposite to another surface thereof that faced the ink-jet heads 2 when the sheet was delivered from the sheet cassette 31 to the sheet conveying mechanism 21, so that recording or printing can be carried out on both surfaces of the sheet.

Each of the four ink-jet heads 2 has an ejection surface 2*a* in which are formed a plurality of nozzles through which ink is ejected. The four ink-jet heads 2 extend in the main scanning direction that is perpendicular to the sub scanning direction and are arranged side by side in the sub scanning direction. The ink-jet heads 2 are supported by the casing 10 via a frame 3. That is, the ink-jet printer 1 is a color ink-jet printer of a line type in which each ink-jet head 2 has a length as measured in the main scanning direction larger than the width of the sheet, whose ink-jet heads 2 are made immovable in the main scanning direction, and which can carry out duplex recording (printing) on both surfaces of the sheet. Since the four ink-jet heads 2 are arranged side by side in the sub scanning direction, high-speed printing on the sheet is realized.

The maintenance unit 50 is configured to conduct a purging operation for restoring ejection performance of the ink-jet heads 2 suffering from ejection failure and a wiping operation for wiping the ejection surfaces 2*a* of the ink-jet heads 2. The maintenance unit 50 includes: four caps 52 arranged side by side in the sub scanning direction so as to be spaced apart from each other by a distance that is equal to a distance by which the four ink-jet heads 2 are spaced apart from each other; a tray 51 that biases the four caps 52 upward through springs not shown; a movable plate 53 that is movable above the four caps 52 in the main scanning direction; and a wiper 54 disposed on the upper surface of the movable plate 53 and having a dimension as measured in the sub scanning direction that is slightly larger than a dimension of the entirety of the four caps 52 as measured in the same direction. The wiper 54 is formed of an elastic material such as rubber. The maintenance unit 50 has a length as measured in the main scanning direction that is larger than the length of the ink-jet recording heads 2 as measured in the main scanning direction.

Except when a maintenance operation of the ink-jet heads 2 is conducted, the maintenance unit 50 is kept stationary, namely, kept in a standby state, at a retracted (standby) position thereof which is on the downstream side of the ink-jet heads 2 in the sheet conveyance direction and at which the maintenance unit 50 is not opposed to the ink-jet heads 2. In this state, the movable plate 53 and the wiper 54 are located outwardly of one of opposite ends of each of the caps 52 in the main scanning direction.

When the maintenance operation is conducted, the ink-jet heads 2 are initially moved upward by the elevating mechanism not shown to a height level where the ejection surfaces 2*a* of the ink-jet heads 2 are located higher than the top end of the wiper 54. Subsequently, the maintenance unit 50 is moved horizontally by a moving mechanism not shown from the retracted position to a maintenance position at which the maintenance unit 50 is opposed to the ink-jet heads 2. Thereafter, the ink-jet heads 2 are moved downward by the elevating mechanism until the peripheral portion of the ejection surface 2*a* of each of the four ink-jet heads 2 comes into close contact with a corresponding one of the four caps 52.

Since the peripheral portion of the ejection surface 2*a* of each ink-jet heads 2 comes into close contact with the corresponding cap 52, the fluid tightness of an enclosed space formed by the cap 52 and the ejection surface 2*a* is made higher, so that the ink staying in the nozzles is prevented from being dried. Further, the purging operation in which the ink is forcibly ejected from the ink-jet heads 2 is conducted by sucking the enclosed space defined by each of the caps 52 and each of the ejection surfaces 2*a* to a negative pressure, by means of a suction pump not shown. The ink accumulated in each cap 52 is discharged into a waste ink tank from a hole not shown formed at the bottom of the cap 52.

After the purging operation has been finished, the ink-jet heads 2 are moved upward by the elevating mechanism to a position at which the ejection surfaces 2*a* of the ink-jet heads 2 are to come into slight contact with the top end of the wiper 54. Subsequently, the movable plate 53 is moved by a horizontally-moving mechanism not shown from the above-indicated one of the opposite ends of each of the caps 52 in the main scanning direction to the other end of each of the caps 52 in the main scanning direction, whereby the wiper 54 is moved in the main scanning direction while contacting the ejection surfaces 2*a* of the ink-jet heads 2. Thus, the wiping operation is conducted to wipe the ink adhering to the ejection surfaces 2*a* therefrom.

Inside the loop of the sheet conveyor belt 8, a platen 19 having a substantially rectangular parallelepiped shape is disposed so as to face the four ink-jet heads 2 and the maintenance unit 50. The upper surface of the platen 19 is held in contact with the inner circumferential surface of the upper portion of the loop of the sheet conveyor belt 8 and supports the sheet conveyor belt 8 from the inside of the loop. According to the arrangement, the outer circumferential surface of the upper portion of the loop of the sheet conveyer belt 8 and the lower surfaces of the ink-jet heads 2 are opposed to each other so as to be parallel to each other, and there is formed a slight clearance therebetween. The clearance partially constitutes the above-indicated sheet delivery path extending from the sheet supplier 30 to the sheet receiving portion 80. When the sheet conveyed and held on the outer circumferential surface of the sheet conveyor belt 8 passes right below the four ink-jet heads 2, the inks of different colors are ejected from the respective ink-jet heads 2 toward the upper surface of the sheet, whereby an intended color image is formed on the sheet.

The four ink-jet heads 2 are connected respectively to four ink tanks 71 disposed in the ink tank cassette 70 so as to be arranged in the direction parallel to the sub scanning direction. In other words, the inks of mutually different colors corresponding to the respective ink-jet heads 2 are stored in the respective four ink tanks 71 and are supplied therefrom to the respective ink-jet heads 2 via tubes or the like (not shown).

A scanner 90 as a reading portion is disposed above the sheet receiving portion 80. The scanner 90 includes a flat reading surface 91 formed of a glass plate, a reading unit 92 for reading an image of a sheet placed on the reading surface 91, and a cover 93 configured to cover the reading surface 91. The scanner 90 is configured such that the reading unit 92 reads the image of the sheet in a state in which the sheet is placed on the reading surface 92 with the cover 93 closed.

Referring next to the block diagram of FIG. 3, there will be explained a control system of the ink-jet printer 1. The control portion 100 includes a Central Processing Unit (CPU) as a processing unit, a Read Only Memory (ROM) in which are stored a control program to be executed by the CPU and data to be used in the control program, and a Random Access Memory (RAM) for temporarily storing data when the program is executed. The CPU, ROM, and RAM function as a head control portion 101, a delivery control portion 102, a retaining judging portion 103, a drying control portion 104, and a distribution control portion 105.

The head control portion 101 is configured to control a head drive circuit 121 such that the ink-jet heads 2 eject ink based on recording data of an image which is to be recorded on the sheet. The recording data is sent from a PC 200.

The delivery control portion 102 is configured to control a motor driver 122 such that an uppermost one of the sheets in the sheet cassette 31 is delivered onto the sheet conveyor belt 8 by rotation of the sheet supply roller 32 which is driven by the sheet supply motor 132 and to control a motor driver 123 such that the sheet is held and conveyed on the sheet conveyor belt 8 by rotation of the belt roller 7 which is driven by the sheet delivery motor 133.

The retaining judging portion 103 is configured to judge whether the sheet on which the image has been recorded by the ink-jet heads 2 needs to be retained and held by any one of the sheet retaining units 40, based on the recording data of the image sent from the PC 200. More specifically, the retaining judging portion 103 calculates an amount of the ink ejected from the ink-jet heads 2 based on the recording data of the image sent from the PC 200 and determines, based on the calculated ink amount, a retention time during which the sheet is to be retained and held by one of the sheet retaining units 40. Where the calculated ink amount is larger than a prescribed amount, the retention time is proportionally increased from a reference retention time during which the sheet is to be retained and held by one of the sheet retaining units 40 when the ink amount is equal to the prescribed amount. Where the calculated ink amount is smaller than the prescribed amount, the retaining judging portion 103 judges that the sheet need not be retained and held by any of the sheet retaining units 40.

The drying control portion 104 is configured to apply a voltage to the heating wires 42 so as to allow the same 42 to generate the heat and keep the inside of each of the sheet retaining units 40 under a high temperature condition, where the retaining judging portion 103 judges that the image-recorded sheet needs to be retained and held by one of the sheet retaining units 40.

The distribution control portion 105 is configured to swing the distributing plates 34*a*, 34*b* by driving the distribution motors 134, 135 and control the motor drivers 124, 125 such that the sheet delivered from the sheet conveying mechanism 21 is distributed selectively into one of: any one of the two sheet retaining units 40*a*, 40*b*; and the sheet receiving portion 80.

Next, a sheet delivering operation in single-sided recording (printing) will be explained. Initially, the sheet supply motor 132 is driven by the control of the delivery control portion 102 to thereby rotate the sheet supply roller 32, so that the uppermost one of the sheets in the sheet cassette 31 is delivered to the sheet conveying mechanism 21 while being guided by the sheet guides 27*a*-27*c* and nipped by the rollers of each of the roller pairs 26*a*, 26*b* and the rollers of the separating roller pair 26*c*.

Subsequently, the head drive circuit 121 is controlled such that the ink is ejected from the ink-jet heads 2 onto the sheet conveyed on the sheet conveyor belt 8 with the ink-jet heads 2 kept stationary, so that a desired image is recorded on the sheet. Then the image-recorded sheet is delivered upward while being guided by the sheet guide 29*a*, 29*b* and nipped by the rollers of each of the roller pairs 28*a*, 28*b*.

In a time period between the instant when the sheet is supplied and the instant when an image is recorded on that sheet, the retaining judging portion 103 judges whether the image-recorded sheet needs to be retained and held by the sheet retaining unit 40*a*. Where the retaining judging portion 103 judges that the image-recorded sheet needs to be retained and held by the sheet retaining portion 40*a*, the distributing plate 34*a* is moved to the position indicated by the solid line in FIG. 2 and the distributing guide plate 34*b* is moved to the position indicated by the broken line in FIG. 2, by the distribution control portion 105, whereby the sheet is delivered to the sheet retaining unit 40*a* while being guided by the sheet guide 33*a* and nipped by the rollers of the roller pair 35*a*. The sheet is retained and held by the sheet retaining unit 40*a* for a suitable retention time determined by the retaining judging portion 103 with its trailing end nipped by the rollers of the roller pair 35*a*.

Since the inside of the sheet retaining unit 40*a* is kept under the high temperature condition due to the heat generated by the heating wires 42, the image-recorded sheet is dried. After the retention time has elapsed, the sheet that has been retained by the sheet retaining unit 40*a* is switchback-delivered from the sheet retaining unit 40*a* while being guided by the sheet guides 29*a*, 33*a*, 36 and nipped by the rollers of each of the roller pairs 35*a*, 28*a*, 28*b*. Thereafter, the distributing guide plate 34*b* is moved to the position indicated by the solid line in FIG. 2 by the distribution control portion 105, so that the sheet is discharged to the sheet receiving portion 80 while being guided by the sheet guides 29*a*, 33*c*, 36 and nipped by the rollers of each of the roller pairs 28*a*, 28*b*, 38.

Where the retaining judging portion 103 judges that the image-recorded sheet need not be retained and held by the sheet retaining portion 40*a*, the distributing plate 34*a* is moved to the position indicated by the solid line in FIG. 2 and the distributing guide plate 34*b* is moved to the position indicated by the solid line in FIG. 2, by the distribution control portion 105, whereby the sheet is discharged to the sheet receiving portion 80 while being guided by the sheet guide 33*c* and nipped by the rollers of the roller pair 38. In the above arrangement, the retaining judging portion 103 makes a judgment as to whether the sheet needs to be retained and held by one of the sheet retaining units 40, and the sheet is allowed to pass through one of the sheet retaining units 40 without being retained thereby in an instance where the sheet need not be retained, thereby minimizing a need of retention of the sheet by the sheet retaining units 40.

The image recording operation is similarly conducted on the second and the following sheets that are sequentially delivered from the sheet cassette 31 after the above-indicated uppermost first one of the sheets. Where the retention time of the first sheet has not elapsed yet and the first sheet retained by the sheet retaining unit 40*a* has not been discharged yet, the distributing plate 34*a* disposed in the sheet guide 33 is moved to the position indicated by the broken line in FIG. 2 by the distribution control portion 105, and the second sheet on which the image has been recorded is delivered to the sheet retaining unit 40*b* while being guided by the sheet guide 33*b* and nipped by the rollers of the roller pair 35*b*. In an instance where only one sheet retaining unit 40 is provided and a sheet is kept retained by that one sheet retaining unit 40, another sheet which is to be next retained cannot be retained by the one sheet retaining unit 40 until the preceding sheet retained by the one sheet retaining unit 40 is delivered therefrom. In view of this, a plurality of sheet retaining units 40 are provided and each of the sheets delivered from the sheet conveying mechanism 21 is distributed by the distributing plate 34*a* selectively into any one of the plurality of sheet retaining units 40, thereby ensuring high-speed printing.

Next, a sheet delivering operation in double-sided or duplex recording (printing) will be explained on the assumption that the retaining judging portion 103 judges that all of the image-recorded sheets need to be retained by any one of the sheet retaining units 40, in the duplex printing.

Initially, the sheet supply motor 132 is driven by the control of the delivery control portion 102 to thereby rotate the sheet supply roller 32, so that an uppermost first one of the sheets (i.e., a first sheet) in the sheet cassette 31 is delivered to the sheet conveying mechanism 21 while being guided by the sheet guides 27*a*-27*c* and nipped by the rollers of each of the roller pairs 26*a*, 26*b* and the rollers of the separating roller pair 26*c*.

Subsequently, the head drive circuit 121 is controlled such that the ink is ejected from the ink-jet heads 2 onto the front surface of the first sheet conveyed on the sheet conveyor belt 8, which front surface is opposed to the ejection surfaces 2*a*. Thus, a desired image is recorded on the front surface of the first sheet. Then the image-recorded first sheet is delivered upward while being guided by the sheet guide 29*a*, 29*b* and nipped by the rollers of each of the roller pairs 28*a*, 28*b*.

Subsequently, the distributing plate 34*a* is moved to the position indicated by the solid line in FIG. 2 and the distributing plate 34*b* is moved to the position indicated by the broken line in FIG. 2, by the distribution control portion 105, whereby the first sheet is delivered to the sheet retaining unit 40*a* while being guided by the sheet guide 33*a* and nipped by the rollers of the roller pair 35*a*. The first sheet is retained and held by the sheet retaining unit 40*a* with its trailing end nipped by the rollers of the roller pair 35*a*. Since the inside of the sheet retaining unit 40*a* is kept under the high temperature condition due to the heat generated by the heating wires 42, the image-recorded first sheet is dried.

In a state in which the first sheet is retained by the sheet retaining unit 40*a*, a second sheet that follows the first sheet is delivered from the sheet cassette 31 and a desired image is recorded on the front surface of the second sheet in a manner similar to that described above. Subsequently, the image-recorded second sheet is delivered upward while being guided by the sheet guides 29*a*, 29*b* and nipped by the rollers of each of the roller pairs 28*a*, 28*b*.

Then the distributing plate 34*a* disposed in the sheet guide 33 is moved to the position indicated by the broken line in FIG. 2 by the distribution control portion 105, whereby the second sheet is delivered to the sheet retaining unit 40*b* while being guided by the sheet guide 33*b* and nipped by the rollers of the roller pair 35*b*. The second sheet is retained and held by the sheet retaining unit 40*b* with its trailing end nipped by the rollers of the roller pair 35*b*. Since the inside of the sheet retaining unit 40*b* is kept under the high temperature condition due to the heat generated by the heating wires 42, the image-recorded second sheet is dried.

In a state in which the second sheet is retained by the sheet retaining unit 40*b* and a desired image is being similarly recorded on the front surface of a third sheet that is supplied from the sheet cassette 31 following the second sheet, the distribution plate 34*a* is moved to the position indicated by the solid line in FIG. 2 by the distribution control portion 105, and the first sheet that has been retained by the sheet retaining unit 40*a* is switchback-delivered to the sheet return path 60 while being guided by the sheet guides 29*a*, 29*b*, 33*a* and nipped by the rollers of each of the roller pairs 28*a*, 28*b*, 35*a*.

Thereafter, the third sheet is delivered to the sheet retaining unit 40*a* while being guided by the sheet guide 33*a* and nipped by the rollers of the roller pair 35*a*. The third sheet is retained and held by the sheet retaining unit 40*a* with its trailing end nipped by the rollers of the roller pair 35*a*.

Subsequently, the first sheet which has been delivered to the sheet return path 60 is delivered again to the sheet conveying mechanism 21 while being guided by the sheet guides 36, 61*a*-61*e* and nipped by the rollers of each of the roller pairs 37, 62*a*-62*d*, so that the back surface of the first sheet opposite to the image-recorded front surface is opposed to the ejection surfaces 2*a* of the ink-jet heads 2.

In a state in which the third sheet is retained by the sheet retaining unit 40*a* and a desired image is being similarly recorded on the back surface of the first sheet, the distribution plate 34*a* is moved to the position indicated by the broken line in FIG. 2 by the distribution control portion 105, and the second sheet that has been retained by the sheet retaining unit 40*b* is switchback-delivered to the sheet return path 60 while being guided by the sheet guides 29*a*, 29*b*, 33*b* and nipped by the rollers of each of the roller pairs 28*a*, 28*b*, 35*b*.

Thereafter, the first sheet whose back surface has been subjected to the image recording is delivered to the sheet retaining unit 40*b* while being guided by the sheet guides 29*a*, 29*b*, 33*b* and nipped by the rollers of each of the roller pairs 28*a*, 28*b*, 35*b*. The first sheet having the image-recorded front and back surfaces is retained and held by the sheet retaining unit 40*b* with its trailing end nipped by the rollers of the roller pair 35*b*.

Then the second sheet which has been delivered to the sheet return path 60 is delivered again to the sheet conveying mechanism 21 while being guided by the sheet guides 36, 61*a*-61*e* and nipped by the rollers of each of the roller pairs 37, 62*a*-62*d*, so that the back surface of the second sheet opposite to the image-recorded front surface is opposed to the ejection surfaces 2*a* of the ink-jet heads 2.

In a state in which the first sheet is retained by the sheet retaining unit 40*b* and a desired image is being similarly recorded on the back surface of the second sheet, the distributing plate 34*a* is moved to the position indicated by the solid line in FIG. 2 by the distribution control portion 105, and the third sheet that has been retained by the sheet retaining unit 40*a* is switchback-delivered to the sheet return path 60 while being guided by the sheet guides 29*a*, 29*b*, 33*a* and nipped by the rollers of each of the roller pairs 28*a*, 28*b*, 35*a*.

Thereafter, the second sheet whose back surface has been subjected to the image recording is delivered to the sheet retaining unit 40*a* while being guided by the sheet guides 29*a*, 29*b*, 33*a* and nipped by the rollers of each of the roller pairs 28*a*, 28*b*, 35*a*. The second sheet having the image-recorded front and back surfaces is retained and held by the sheet retaining unit 40*a* with its trailing end nipped by the rollers of the roller pair 35*a*.

The first sheet that has been retained by the sheet retaining unit 40*b* is switchback-delivered from the sheet retaining unit 40*b* while being guided by the sheet guides 29*a*, 33*b*, 36 and nipped by the rollers of each of the roller pairs 35*b*, 28*a*, 28*b*. Then the distributing plate 34*a* is moved to the position indicated by the solid line in FIG. 2 and the distributing plate 34*b* is moved to the position indicated by the solid line in FIG. 2, by the distribution control portion 105, so that the first sheet is discharged to the sheet receiving portion 80 while being guided by the sheet guides 29*a*, 33*c*, 36 and nipped by the rollers of each of the roller pairs 28*a*, 28*b*, 38.

In a state in which the second sheet is retained by the sheet retaining unit 40*a*, a fourth sheet that follows the third sheet is supplied from the sheet cassette 31 and a desired image is recorded on the front surface of the fourth sheet in a manner similar to that described above. Then the distributing plate 34*a* is moved to the position indicated by the broken line in FIG. 2 by the distribution control portion 105, and the fourth sheet whose front surface has been subjected to the image recording is delivered to the sheet retaining portion 40*b* while being guided by the sheet guides 29*a*, 29*b*, 33*b* and nipped by the rollers of each of the roller pairs 28*a*, 28*b*, 35*b*.

Then the third sheet which has been delivered to the sheet return path 60 is delivered again to the sheet conveying mechanism 21 while being guided by the sheet guides 36, 61*a*-61*e* and nipped by the rollers of each of the roller pairs 37, 62*a*-62*d*, so that the back surface of the third sheet opposite to the image-recorded front surface is opposed to the ejection surfaces 2*a* of the ink-jet heads 2.

In a state in which the second sheet is retained by the sheet retaining unit 40*a* and a desired image is being similarly recorded on the back surface of the third sheet, the fourth sheet which has been retained by the sheet retaining unit 40*b* is switchback-delivered to the sheet return path 60 while being guided by the sheet guides 29*a*, 29*b*, 33*b* and nipped by the rollers of each of the roller pairs 28*a*, 28*b*, 35*b*.

Thereafter, the third sheet whose back surface has been subjected to the image recording is delivered to the sheet retaining unit 40*b* while being guided by the sheet guide 33*b* and nipped by the rollers of the roller pair 35*b*. The third sheet having the image-recorded front and back surfaces is retained and held by the sheet retaining unit 40*b*. The second sheet that has been retained by the sheet retaining unit 40*a* is switchback-delivered from the sheet retaining unit 40*a* while being guided by the sheet guides 29*a*, 33*a*, 36 and nipped by the rollers of each of the roller pairs 28*a*, 28*b*, 35*a*. Then the distributing plate 34*a* is moved to the position indicated by the solid line in FIG. 2 and the distributing plate 34*b* is moved to the position indicated by the solid line in FIG. 2, by the distribution control portion 105, so that the second sheet is discharged to the sheet receiving portion 80 while being guided by the sheet guides 29*a*, 33*c*, 36 and nipped by the rollers of each of the roller pairs 28*a*, 28*b*, 38. The above-described procedure is repeated, so that the ink-jet printer 1 according to the present embodiment can conduct the duplex printing on the plurality of sheets. Further, in the ink-jet printer 1, the sheet retaining units 40 function as a spacing utilized when the sheet is switchback-delivered to the sheet return path 60 in the duplex printing.

The above explanation relating to the duplex printing is made on the assumption that the retaining judging portion 103 always judges that all of the image-recorded sheets need to be retained by any one of the sheet retaining units 40. In an instance where there exists a sheet which need not be retained by the sheet retaining units 40, only that sheet may be switchback-delivered to the sheet return path 60 without being retained after having been once delivered to one of the sheet retaining units 40 from the sheet conveying mechanism 21 or may be discharged directly to the sheet receiving portion 80 without being delivered to any one of the sheet retaining units 40.

In the ink-jet printer 1 according to the present embodiment, the sheet retaining units 40 are disposed above the ink-jet heads 2 and the sheet receiving portion 80 is disposed above the sheet retaining units 40, such that the ink-jet heads 2, the sheet retaining portions 40, and the sheet receiving portion 80 at least partially overlap each other as viewed from the top of the ink-jet printer 1. Accordingly the ink-jet printer 1 has a reduced size in the sub scanning direction.

There will be next described some modifications of the invention. In the modifications described below, the same reference numerals as used in the illustrated embodiment are used to identify the corresponding components, and its detailed explanation is dispensed with.

In the illustrated embodiment, the heating wires 42 are provided in the sheet retaining units 40 for the purpose of reducing a time required for drying the image-recorded sheets. Where the ink-jet printer 1 affords enough time for drying the sheets, the heating wires 42 may not be provided in the sheet retaining units 40.

In place of the heating wires 42, a heater such as a halogen heater, a far-infrared heater, or a near-infrared heater may be disposed on one of opposite sides of each sheet retaining unit 40 in the direction parallel to the main scanning direction. In this instance, the sheet may be dried by a flow of the air by a fan warmed by the heat generated as a result of driving of the heater.

In an instance where it takes a long retention time in the sheet retaining units 40 or high speed printing is desired, the number of the sheet retaining units 40 arranged in the vertical direction may be increased. If only one sheet retaining unit 40 is provided and a sheet is kept retained by that one sheet retaining unit 40, another sheet which is to be next retained cannot be retained by the one sheet retaining unit 40 until the preceding sheet kept retained in the one sheet retaining unit 40 is discharged to the sheet receiving portion 80. In view of this, the sheet retaining unit 40 may be provided in a plural number and the sheets may be distributed by the distributing plates 34 selectively into any one of the plural sheet retaining units 40, whereby the number of the sheets that can be retained is increased so as to ensure high-speed printing. In other words, the number of the sheet retaining unit 40 may be one or more depending upon the retention time and the printing operation.

The control portion 100 may not have the retaining judging portion 103 and all of the sheets may be retained by any of the sheet retaining units 40. In this instance, the control by the control portion 100 is simplified.

In the illustrated embodiment, the maintenance unit 50 is disposed alongside the ink-jet heads 2 in the sub scanning direction. The maintenance unit 50 may be otherwise disposed. For instance, the maintenance unit 50 may be disposed between any adjacent two of the four ink-jet heads 2. Alternatively, each of the four caps 52 of the maintenance unit 50 may be disposed adjacent to a corresponding one of the ink-jet heads 2 in the sub scanning direction.

It is to be understood that the principle of the invention may be applicable not only to the ink-jet printer in the illustrated embodiment, but also to various image recording apparatus. It is to be further understood that the invention is not limited to the details of the illustrated embodiment, but may be embodied with various changes and modifications, which may occur to those skilled in the art, without departing from the spirit and scope of the invention defined in the attached claims.

What is claimed is:

1. An image recording apparatus, comprising:

a recording head configured to record an image on a recording medium;

a conveying mechanism disposed so as to face the recording head and configured to convey the recording medium in a medium conveyance direction that is substantially horizontal;

a retaining portion disposed configured to hold and retain the recording medium on which the image has been recorded by the recording head, such that the recording medium is held and retained in a substantially horizontal posture; and a medium receiving portion to which the recording medium on which the image has been recorded by the recording head is discharged, wherein the recording head, the retaining portion, and the medium receiving portion are arranged in a vertical direction perpendicular to an ejection face of the recording head, such that at least a portion of the recording head overlaps at least a portion of the retaining portion in the vertical direction, and wherein the retaining portion comprises a drier configured to dry the recording medium on which the image has been recorded by the recording head.

2. The image recording apparatus according to claim 1, wherein the retaining portion is disposed between the recording head and the medium receiving portion in the vertical direction.

3. The image recording apparatus according to claim 1, which is configured such that the recording medium retained by the retaining portion is switchback-delivered and discharged to the medium receiving portion.

4. The image recording apparatus according to claim 1, wherein the retaining portion is disposed in a plural number so as to provide plural retaining portions arranged in the vertical direction, and wherein the apparatus further comprises a distributing mechanism disposed on a medium delivery path between the plural retaining portions and the recording head and configured to distribute the recording medium on which the image has been recorded by the recording head selectively into any one of the plural retaining portions.

5. The image recording apparatus according to claim 1, wherein the recording head is disposed in a plural number so as to provide plural recording heads that are arranged in the medium conveyance direction.

6. The image recording apparatus according to claim 1, further comprising a maintenance unit disposed, in its standby state, alongside the recording head in the medium conveyance direction and configured to perform maintenance of the recording head.

7. The image recording apparatus according to claim 6, wherein the maintenance unit is configured to be moved in a direction parallel to the medium conveyance direction from a standby position at which the maintenance unit is in its standby state to a maintenance position at which the maintenance unit is opposed to the recording head and is configured to conduct, at the maintenance position, a purging operation for restoring ejection performance of the recording head suffering from ejection failure and a wiping operation for wiping an ejection surface of the recording head.

8. The image recording apparatus according to claim 1, further comprising a casing in which the conveying mechanism, the recording head, and the retaining portion are disposed, wherein the retaining portion is removably attached to the casing.

9. The image recording apparatus according to claim 8, wherein the retaining portion is attached to the casing so as to be removable in a direction parallel to a direction in which the recording medium is delivered.

10. The image recording apparatus according to claim 1, further comprising a judging portion configured to judge whether the recording medium on which the image has been recorded needs to be held and retained by the retaining portion, based on recording data of the image for recording the image on the recording medium, wherein where the judging portion judges that the recording medium needs to be retained by the retaining portion, the recording medium is delivered from the conveying mechanism to the retaining portion and is held and retained by the retaining portion and where the judging portion judges that the recording medium need not be retained by the retaining portion, the recording medium is delivered from the conveying mechanism to the medium receiving portion without being delivered to the retaining portion.

11. The image recording apparatus according to claim 1, further comprising a medium return path through which the recording medium that has been conveyed by the conveying mechanism is delivered again back to the medium conveying mechanism, wherein where duplex recording is carried out, the recording medium on which the image has been recorded by the recording head is once delivered to the retaining portion and is subsequently switchback-delivered to the medium return path.

12. The image recording apparatus according to claim 11, wherein the medium return path is configured such that the recording medium delivered therethrough passes below the conveying mechanism.

13. The image recording apparatus according to claim 1, further comprising a reading portion disposed above the medium receiving portion and configured to read an image.

14. The image recording apparatus according to claim 1, further comprising a supply portion disposed below the recording head so as to accommodate the recording medium and configured to supply the recording medium to the conveying mechanism.

15. The image recording apparatus according to claim 1, wherein the recording head extends in a perpendicular direction that is horizontal and perpendicular to the medium conveyance direction and has a length as measured in the perpendicular direction that is larger than a width of the recording medium and the recoding head is immovable in the perpendicular direction during a recording operation.

16. The image recording apparatus according to claim 15, further comprising a maintenance unit disposed, in its standby state, alongside the recording head in the medium conveyance direction and configured to perform maintenance of the recording head, wherein the maintenance unit has a length as measured in the perpendicular direction that is larger than the length of the recording head as measured in the perpendicular direction.

* * * * *